United States Patent [19]

Overman

[11] 4,067,530

[45] Jan. 10, 1978

[54] SHELF SUPPORT STRIP

[76] Inventor: Sherman A. Overman, 17622 Orchard Lane, Salinas, Calif. 93901

[21] Appl. No.: 724,026

[22] Filed: Sept. 16, 1976

[51] Int. Cl.[2] ..... A47B 57/08

[52] U.S. Cl. ..... 248/235; 108/107; 211/187

[58] Field of Search ..... 248/235, 243; 108/109, 108/106–108, 111, 96, 105, 146; 211/187, 190, 207, 208, 134

[56] References Cited

U.S. PATENT DOCUMENTS

| | | | |
|---|---|---|---|
| 2,783,961 | 3/1957 | Weber | 211/134 X |
| 2,967,625 | 1/1961 | Hoogenstyn | 108/107 |
| 3,481,485 | 12/1969 | Hess | 211/134 |
| 3,645,486 | 2/1972 | Ferdinand et al. | 108/108 X |
| 3,910,204 | 10/1975 | Jesse | 108/901 X |

FOREIGN PATENT DOCUMENTS

| | | | |
|---|---|---|---|
| 431,853 | 9/1967 | Switzerland | 108/109 |

*Primary Examiner*—Roy D. Frazier
*Assistant Examiner*—William E. Lyddane
*Attorney, Agent, or Firm*—John J. Leavitt

[57] ABSTRACT

Presented is a shelf support strip fabricated from a synthetic resinous material and comprising an elongated base member configured in channel form for strength and rigidity and having integrally formed with the web thereof a series of spaced reinforced projections flexible and resilient in their nature and configured to support a shelf disposed thereabove.

6 Claims, 9 Drawing Figures

SHELF SUPPORT STRIP

BACKGROUND OF THE INVENTION

There has been a continuing need for a shelf support strip that is easily applied, is economically manufacturable and which permits the ready applicability of shelves thereon. The prior art is replete with many different types of shelf support brackets, hangers, strips and various other devices for supporting a shelf between two upright parallel end boards. So far as is known, none of these shelf support means are fabricated from a plastic or synthetic resinous material. Accordingly, one of the important objects of the present invention is to provide a shelf support strip or bracket that is wholly fabricated from a synthetic resinous material.

Many conventional shelf support means utilize two or three different parts. One of such parts frequently takes the form of an elongated strip, pairs of which are securely fastened to opposite upstanding end boards in a shelf assembly, the elongated strips being apertured for application of a second member which is adjusted in height along the length of the strip so as to level the shelves. The shelf support member applied to the apertured strip constitutes a separate element and therefore is not integral with the strip on which it is supported and has the tendency to introduce a weak link into the shelf support system. Accordingly, another object of the invention is to provide a shelf support strip in which all parts thereof except the screw that attaches the strip to the shelf support end board is integral and formed in a single unit.

Conventional shelf support brackets and strips utilize a movable or adjustable shelf hanger unit, generally applicable to an apertured strip so that the hanger unit may be adjusted in height depending upon the height of books, for instance, that might be stacked on a shelf. The present invention eliminates such extra and separate parts and provides a shelf support member integral with the shelf support base strip and formed in such a way that a shelf may be inserted below a shelf support unit or shell and may be raised upwardly so as to initially collapse the shelf support unit to permit passage of the shelf, and which then pops out and supports the shelf once the shelf has been properly positioned for such support.

The invention possesses other objects and features of advantage, some of which with the foregoing, will be apparent from the following description and the drawings. It is to be understood however that the invention is not limited to the embodiment illustrated and described, since it may be embodied in different forms within the scope of the appended claims.

SUMMARY OF THE INVENTION

In terms of broad inclusion, the shelf support strip of the invention comprises a channel-shaped member preferably injection-molded from a suitable synthetic resinous material and having a multiplicity of reinforcing ribs formed within the channel to lend strength to the web that extends integrally between the two side flanges of each channel. Also integrally formed at spaced intervals along the length of the injection-molded strip are apertures surrounded by integral cylindrical support post. At spaced intervals along the web of the channel, there are provided a multiplicity or series of shelf support units, each shelf support unit being integral with the web and being formed with a generally flat upper shelf support edge which projects from the surface of the web at right angles thereto, and which forms the top edge of a generally divergent or conically shaped body portion that merges with the surface of the web. The configuration of the channel is such as to provide rigidity for the strip, while the configuration and thickness of the shelf support unit or shell is controlled to provide collapsibility of the shelf support unit inwardly toward the surface of the web so that the end of the shelf may be squeezed past the collapsed shelf support unit in an upward direction until it is properly positioned for support on the top edge of the shelf support unit after it pops back into its normal position.

BRIEF DESCRIPTION OF THE DRAWINGS

FIGS. 1,2,3,5 and 9 are illustrated approximately two-thirds actual size.

FIGS. 4,6 and 7 are illustrated approximately one and one-half times actual size, while FIG. 8 illustrates the assembly in greatly reduced size.

DESCRIPTION OF THE PREFERRED EMBODIMENT

Figure 1:
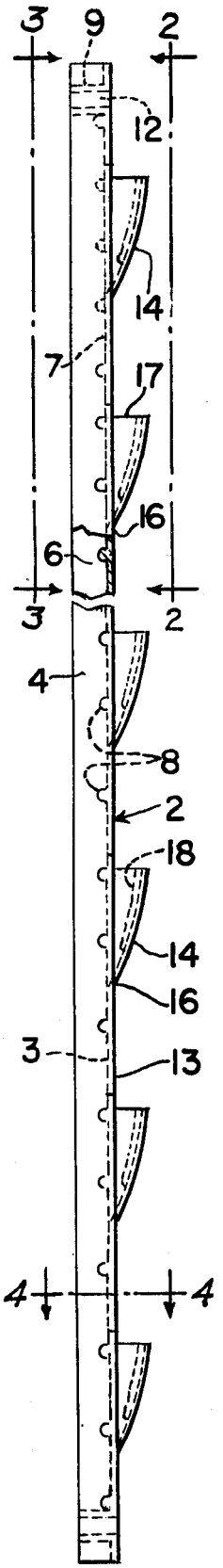
FIG. 1 is a side elevational view of the shelf support strip of the invention, a portion being broken away to reveal the construction thereof and to shorten its length.
Figure 2:
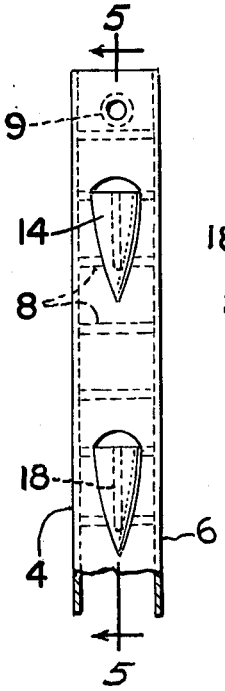
FIG. 2 is a front elevational view of the shelf support strip, a portion being broken away to shorten its length.
Figure 3:
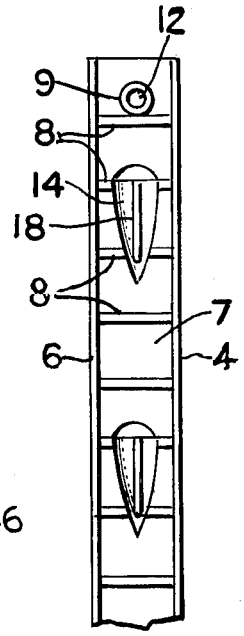
FIG. 3 is a rear view of the shelf support strip, a portion being broken away to shorten its length.

In terms of greater detail, the shelf support strip of the invention comprises an elongated unit designated generally by the numeral 2, and including a web 3 integrally connected with a pair of side flanges 4 and 6. Integrally formed at regular intervals on the inside surface 7 of the web are a plurality of reinforcing ribs 8 that extend integrally between the side flanges 4 and 6 at intervals along the web. Also formed integrally at spaced intervals along the length of the shelf support unit are cylindrical posts 9, each of which defines an aperture 12 through which an appropriate screw (not shown) may be inserted for attachment of the shelf support strip to a supporting bookcase member.

On the exposed or facing surface 13 of the elongated shelf support strip there is provided a multiplicity or series of equally spaced integral projections 14 having the general configuration of one-half of an inverted hollow cone, the apex end 16 of the hollow inverted half cone being integral with the web 3, the integrality continuing upwardly from the apex end 16 of the hollow half conical shell to the base edge or end 17 which lies perpendicular to the front surface 13 of the elongated shelf support strip 2. The web under the inverted hollow cone is apertured as shown, the half cone being integral to the web along the edge of the aperture.

Figure 4:
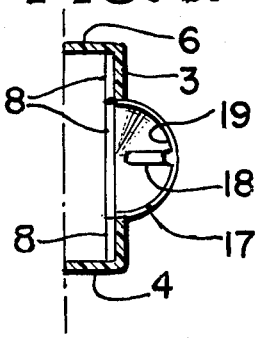
FIG. 4 is a horizontal cross-sectional view taken in the plane indicated by the line 4—4 in FIG. 1.
Figure 6:
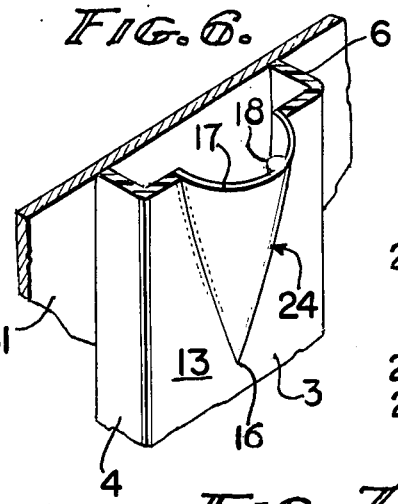
FIG. 6 is a fragmentary perspective view illustrating the integral interconnection of the shelf support channel strip and the shelf support unit that projects therefrom, the shelf support strip being shown associated with a supporting wall surface.

It should be noted that the half cone-like integral shell member 14 projects from the surface 13 for a distance approximately equal to the height of the flanges 4 and 6, and that the upper edge 17 of the half conical shell 14 is somewhat thinner than the shell at the integral apex end 16, the increasing thickness from the upper edge 17 to the apex end 16 being a gradually increasing characteristic to lend strength to the structure. For additional strength, while permitting the characteristic of collapsibility to the projecting member 14, there is provided an elongated strengthening rib 18 formed integrally within the half conical shell and positioned as illustrated in FIG. 4 along the median line of the half conical shell and projecting inwardly from the inner surface 19 of the half conical shell. The integral rib 18 extends downwardly to almost the apex end of the half conical shell as illustrated.

Figure 9:
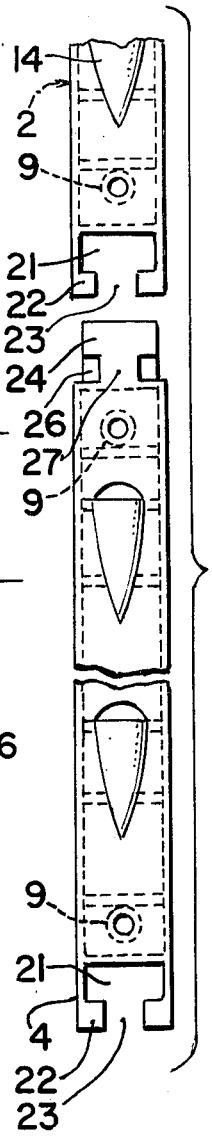
FIG. 9 is a fragmentary elevational view illustrating the face of the shelf support strip and illustrating also the manner of attachment of one strip to another to connect two such strips in an end-to-end relationship.

Preferably, the elongated shelf support strips 2 are fabricated in 2 or 3 foot lengths. It sometimes becomes necessary for two such lengths of shelf support strips to be joined one to the other so as to form a continuous elongated strip having a length equal to a multiple of one of the strips. To accommodate such interlocking relationship reference is made to FIG. 9 in which it is seen that one end of each strip is formed with an aperture 21 formed by elimination of the web 3 at this point, side flanges 4 and 6 being formed with opposite mutually reaching projections 22 as illustrated in FIG. 9, the inner edges of the projections 22 being spaced apart to provide a throat 23. The opposite end of this strip, illustrated in the drawings by showing the complimentary end of an adjacent associated strip, is formed with a lug 24 adapted to fit snuggly in the aperture 21, the lug 24 being formed by a continuation of the web as illustrated, with recesses 26 formed to accommodate the inwardly extending lugs 22. When the two ends of the adjacent strips are interlocked, it will be noted that the neck portion 27 formed as a continuation of the web 3 and formed integrally with the lug 24 will lie in the neck opening 23 of the associated shelf support strip while the lugs 22 will lie in the recesses 26, thus interlocking the two strips end-to-end.

Figure 8:
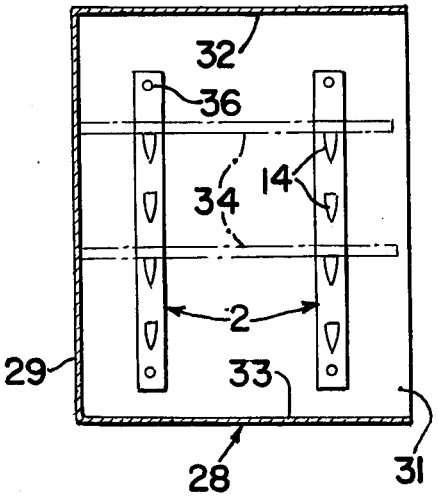
FIG. 8 is an end elevational view illustrating the manner of attachment of a pair of the shelf support strips in a cabinet.

To attach the shelf support strip, or pairs of them, within a bookcase for instance, reference is made to FIG. 8 where there is shown a bookcase designated generally by the numberal 28, the bookcase having a back wall 29 and end or side walls 31, a top wall 32, and a bottom wall 33. Suitably secured within this enclosure, preferably on each side or end wall of the bookcase, are a pair of shelf support strips 2, spaced apart laterally as shown, so that shelves 34 shown in broken lines in the figure may be supported on the inwardly projecting shelf support half conical shells 14 as previously discussed. Each of the strips is suitable secured to the side or end walls of the bookcase by an appropriate fastening device 36 which may be a bolt or screw extending through the opening 12 in the strip.

Figure 5:
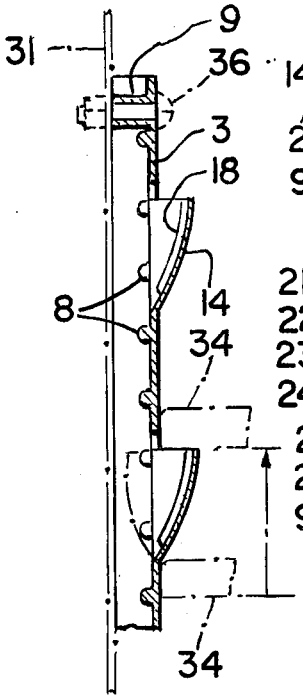
FIG. 5 is a vertical cross-sectional view taken in the plane indicated by the line 5—5 in FIG. 2.
Figure 7:
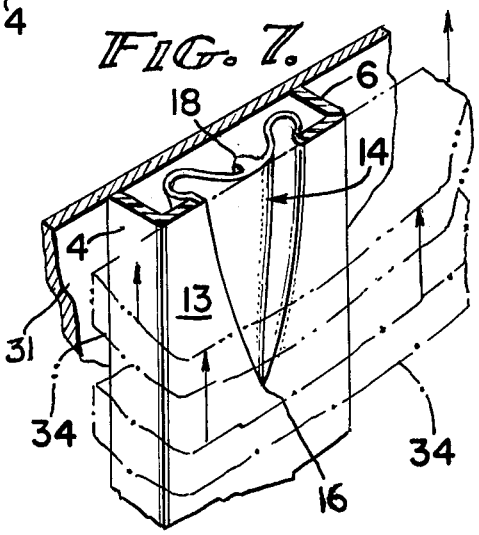
FIG. 7 is a fragmentary perspective view, a portion of which is shown in section, illustrating the manner in which the shelf support unit may be collapsed inwardly by the end of a shelf to be supported thereon.

As illustrated in FIGS. 5 and 7, to apply a shelf 34 between laterally spaced pairs of the shelf support strips, the shelf 34 is inserted between the facing surfaces 13 of the opposed strips, and is then pushed upwardly as indicated in FIGS. 5 and 7 in the direction of the arrows. Upward motion of the shelf causes the end of the shelf to impinge against the surface of the projecting half conical shell 14 and in effect "cams" the half conical shell so that it collapses into the configuration illustrated in FIG. 7, thus permitting the end of the shelf to squeeze past the normally projecting shelf support shell 14 until it assumes the proper position as illustrated in FIG. 5 above the underlying and now normally projecting shelf support unit which has popped out of its collapsed position as illustrated in broken lines in FIG. 5 and in full lines in FIG. 7 after passage of the shelf. With the shelf in place as illustrated in FIGS. 5,7, and 8, downward pressure on the shelf imposes a downward thrust on the upper edge 17 of the half conical shell, the downward thrust being transmitted through the half conical shell into the web 3 so as to adequately support the shelf thereon.

Having thus described the invention what is claimed to be new and novel and desired to be protected by letters patent of the United States is as follows:

1. A shelf support strip comprising:

a. an elongated base member including a web formed from a synthetic resinous material; and b. a series of longitudinally spaced shelf support members integral with said web and projecting therefrom to present a shelf support surface perpendicular to said web and a generally conical force transmitting portion formed as a vertical sectional portion of an inverted cone and connecting said perpendicular shelf support surface to said web, said shelf support surface constituting the base of the conical portion, said conical portion being integrtal with said web along the entire periphery thereof, said web being apertured at the occurrence of each said shelf support member, said shelf support member possessing the characteristic of flexibility and resilience whereby pressure exerted against said support member in a direction toward said web causes resilient collapse of the shelf support member through said associated aperture in the web.

2. The combination according to claim 1, in which said shelf support member comprises a hollow half conical shell.

3. The combination according to claim 1, in which said web beneath each said shelf support member is apertured to provide a triangular shaped opening the sides of which extend longitudinally along said web and said shelf support member is integral with said web along the longitudinally extending sides of said aperture.

4. The combination according to claim 2, in which means are provided integral with said half conical shell to lend rigidity thereto to withstand force applied in the direction of the longitudinal dimension of the support strip.

5. The combination according to claim 2, in which said half conical shell is formed to possess a greater cross-sectional thickness at its union with the web than at other points on its periphery.

6. The combination according to claim 2, in which said base member includes a pair of flanges joined integrally to opposite edges of said web to form a channel-like member, and reinforcing ribs are formed in said channel-like member at spaced intervals to increase the rigidity of said shelf support strip.

* * * * *